US010766044B2

(12) United States Patent
Yi et al.

(10) Patent No.: US 10,766,044 B2
(45) Date of Patent: Sep. 8, 2020

(54) CHANNELED REDUCTANT MIXING DEVICE

(71) Applicants: Yong Yi, Dunlap, IL (US); Samprati Vijay Shah, Peoria, IL (US); Ian Aguirre, Peoria, IL (US); Yung T. Bui, Peoria, IL (US); Arvind Jujare, Peoria, IL (US); Erin Reim, South Bend, IN (US); Anthony C. Rodman, Peoria, IL (US)

(72) Inventors: Yong Yi, Dunlap, IL (US); Samprati Vijay Shah, Peoria, IL (US); Ian Aguirre, Peoria, IL (US); Yung T. Bui, Peoria, IL (US); Arvind Jujare, Peoria, IL (US); Erin Reim, South Bend, IN (US); Anthony C. Rodman, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/198,045

(22) Filed: Nov. 21, 2018

(65) Prior Publication Data

US 2020/0156093 A1 May 21, 2020

(51) Int. Cl.

| | |
|---|---|
| ***B05B 7/04*** | (2006.01) |
| ***B05B 11/06*** | (2006.01) |
| ***B05B 3/00*** | (2006.01) |
| ***B05B 5/00*** | (2006.01) |

(52) U.S. Cl.

CPC ..... *B05B 7/0466* (2013.01); *B05B 11/06* (2013.01); *B05B 3/00* (2013.01); *B05B 5/00* (2013.01)

(58) Field of Classification Search

CPC B05B 3/00; B05B 5/00; B05B 7/0466; B05B 11/06

USPC ..... 60/295, 307; 239/210, 292, 294, 331

See application file for complete search history.

(56) References Cited

U.S. PATENT DOCUMENTS

| | | | | |
|---|---|---|---|---|
| 4,815,665 | A | 3/1989 | Haruch | |
| 7,036,753 | B2 | 5/2006 | Huffman | |
| 7,108,203 | B2 | 9/2006 | Huffman et al. | |
| 8,356,473 | B2 | 1/2013 | Blomquist et al. | |
| 9,168,545 | B2 | 10/2015 | Vidusek et al. | |
| 2008/0022663 | A1* | 1/2008 | Dodge | F01N 3/2066 60/286 |

(Continued)

FOREIGN PATENT DOCUMENTS

CN 204710601 U 10/2015

*Primary Examiner* — Thai Ba Trieu
*Assistant Examiner* — Dapinder Singh
(74) *Attorney, Agent, or Firm* — Hibshman Claim Construction PLLC

(57) ABSTRACT

A reductant impingement device includes a proximal end having an impingement pin with a convex surface; and a distal end having a body concentric with a longitudinal axis of the impingement pin. The distal end includes a first surface and a second surface opposite the first surface. A plurality of inner channels connects the first surface and the second surface, and a plurality of outer channels connects the first surface and the second surface, where the plurality of inner channels are disposed in a circular array at a first radial distance from a longitudinal axis of the impingement pin, and the plurality of outer channels are disposed in a circular array at a second distance from the longitudinal axis of the impingement pin.

20 Claims, 5 Drawing Sheets

(56) References Cited

U.S. PATENT DOCUMENTS

| | | | | |
|---|---|---|---|---|
| 2011/0284652 | A1* | 11/2011 | Amaya | F02M 35/10085 239/8 |
| 2013/0319301 | A1 | 12/2013 | Okazaki et al. | |

* cited by examiner

CHANNELED REDUCTANT MIXING DEVICE

TECHNICAL FIELD

The present disclosure is directed to an exhaust treatment system and, more particularly, to a nozzle that injects a reductant solution into a fluid path within an exhaust treatment system.

BACKGROUND

Internal combustion engines, such as diesel engines, gasoline engines, gaseous fuel-powered engines, and other engines known in the art, exhaust a complex mixture of components into the environment. These components may include nitrogen oxides (NOx), such as NO and $NO_2$. Due to an increased focus on avoiding environmental pollution, exhaust emission standards are becoming more stringent, and in some instances, the amount of NOx emitted from engines may be regulated depending on engine size, engine class, and/or engine type. To ensure compliance with the regulation of these components, as well as reduce environmental effects, some engine manufacturers implement a strategy called Selective Catalytic Reduction (SCR). SCR is a process where gaseous and/or liquid reductant, most commonly urea ($(NH_2)_2CO$), is selectively added to engine exhaust using one or more nozzles. The injected reductant decomposes into ammonia ($NH_3$), reacts with the NOx in the exhaust, and forms water ($H_2O$) and diatomic nitrogen ($N_2$).

U.S. Pat. No. 8,356,473 to Blomquist, issued on Jan. 22, 2013 (hereinafter referred to as the '473 reference), describes an injection device having a first conduit for supplying compressed gas, and a second conduit arranged on the outside of the second conduit for supplying a liquid agent. At least one hole extends between the first conduit and the second conduit. As discussed in the '473 reference, liquid agent flows through the at least one hole into the compressed air. The liquid agent is atomized by the compressed gas, mixed with the compressed gas, and transported through an outlet of the injection device for dispersion into an exhaust line.

While the injection device of the '473 reference may attempt to increase the atomization of the liquid agent, the operation of the injection device may be suboptimal. For example, the injection device described in the '473 reference is relatively small in size, and due to low turbulence and mixing features, effective mixing of the liquid agent may be difficult to achieve. Further, the '473 reference describes an injection device having multiple distinct and assembled parts, and such a device configuration may increase the size, complexity, assembly time, and/or manufacturing cost of the nozzle. Such multi-part devices are also often difficult to clean and may become clogged easily.

Example embodiments of the present disclosure are directed toward overcoming one or more of the deficiencies described above.

SUMMARY OF THE INVENTION

According to one embodiment of the present disclosure, a nozzle, is described that includes a nozzle body. The nozzle body includes proximal end having a first inlet disposed in a direction along a longitudinal axis of the nozzle, and a second inlet having a first air inlet channel disposed at an angle perpendicular to the longitudinal axis of the nozzle. The nozzle includes a distal end disposed opposite the proximal end along the longitudinal axis of the nozzle, the distal end having an outlet. An interior of the nozzle is disposed between the proximal end and the distal end, and includes a fluid impingement chamber that is fluidly connected with the first inlet and the second inlet, and a mixing chamber fluidly connected with an outlet at the distal end. The nozzle also includes an impingement device fluidly connecting the fluid impingement chamber and the mixing chamber. The impingement device includes an impingement pin with a pin body and a convex surface disposed at an end of the impingement pin. The convex surface is concentric with the longitudinal axis of the nozzle.

According to another embodiment of the present disclosure, an impingement device includes an impingement pin and a device body coaxial with a longitudinal axis of the impingement pin. The device body is disposed to the impingement pin at a distal end of the impingement device. The impingement pin includes a convex surface at a proximal end of the device. The device body includes a first surface, a second surface opposite the first surface, and a plurality of inner channels connecting the first surface and the second surface. The plurality of inner channels are disposed in a first circular array at a first radial distance from a longitudinal axis of the impingement pin. The device body further includes a plurality of outer channels connecting the first surface and the second surface. The plurality of outer channels is disposed in a second circular array at a second radial distance from the longitudinal axis of the impingement pin.

According to yet another embodiment, an exhaust system is described. The exhaust system includes an exhaust pipe configured to receive exhaust from an engine, a compressed air source, a reductant source, and a nozzle fluidly connected with the exhaust pipe. The nozzle is configured to receive air from the compressed air source and reductant from the reductant source. The nozzle includes an impingement pin and a device body coaxial with a longitudinal axis of the impingement pin. The device body is disposed to the impingement pin at a distal end of the impingement device. The impingement pin includes a convex surface at a proximal end of the device. The device body includes a first surface, a second surface opposite the first surface, and a plurality of inner channels connecting the first surface and the second surface. The plurality of inner channels are disposed in a first circular array at a first radial distance from a longitudinal axis of the impingement pin. The device body further includes a plurality of outer channels connecting the first surface and the second surface. The plurality of outer channels is disposed in a second circular array at a second radial distance from the longitudinal axis of the impingement pin.

DETAILED DESCRIPTION

This disclosure generally relates to nozzles useful for injecting a mixture of reductant and air into an exhaust stream. Wherever possible, the same reference number(s) will be used through the drawings to refer to the same or like features. In the figures, the left-most digit(s) of a reference number identifies the figure in which the reference number first appears.

Figure 1:
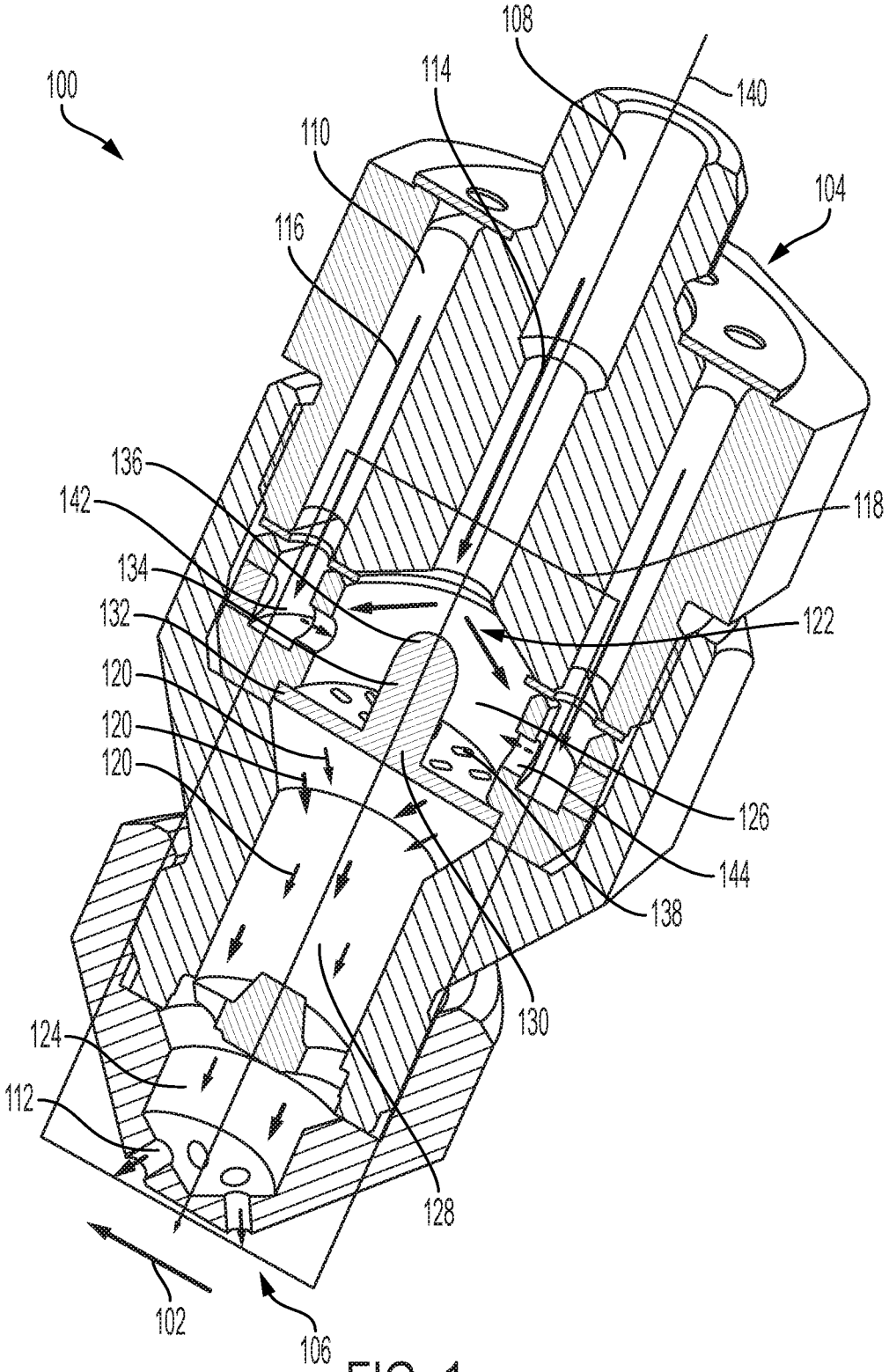
FIG. 1 is a perspective view of a reductant nozzle of an exhaust system, according to an embodiment of the present disclosure.

FIG. 1 illustrates an example nozzle 100. For the purposes of this disclosure, the nozzle 100 is shown and described in use with a diesel-fueled, internal combustion engine. However, the nozzle 100 may embody a reductant nozzle operative as part of any exhaust system useable with any other type of combustion engine such as a gasoline or a gaseous fuel-powered engine, or an engine fueled by compressed or liquefied natural gas, propane, or methane.

Selective Catalytic Reduction (SCR) is an active emissions control technology system that injects a liquid reductant agent through a catalyst into the exhaust stream of a diesel engine. The reductant source is usually automotive-grade urea, otherwise known as Diesel Exhaust Fluid (DEF). In some embodiments, the reductant may include DEF, an ammonia gas, liquefied anhydrous ammonia, ammonium carbonate, an ammine salt solution, a hydrocarbon such as diesel fuel, or another solution. In DEF reactions, the DEF sets off a chemical reaction that converts nitrogen oxides into nitrogen, water and tiny amounts of carbon dioxide (CO2), natural components of the air we breathe, which is then expelled through the vehicle tailpipe. Embodiments of the present disclosure may reduce emissions increasing the effectiveness of SCR systems in the emission control of diesel combustion engines.

An engine (not shown in FIG. 1) may produce an exhaust stream 102. The nozzle 100 may inject reductant into the exhaust stream 102. The nozzle 100 is configured to spray a reductant solution (or other compound(s)) into the exhaust stream 102. The nozzle 100 may include a proximal end 104 and a distal end 106 disposed opposite the proximal end 104. The nozzle 100 may fluidly connect a supply line (not shown in FIG. 1) that supplies reductant (not shown) to a first inlet 108, which may be an inlet for reductant, at the proximal end 104 of the nozzle 100, and via one or more fittings or couplers (not shown). The nozzle 100 may include a compressed air inlet channel 142 that can be fluidly connected to a supply of compressed air for supplying the compressed air 116 to a second inlet 110. As explained in greater detail hereafter, the nozzle 100 may be configured to mix reductant solution 114 and compressed air 116 in extreme heat environments such that the reductant maintains an operative temperature without reductant crystallization that may clog the nozzle.

In some embodiments, the nozzle 100 may be manufactured using 3D printing techniques or other types of additive manufacturing (e.g., cast molding) and comprise a single piece of material. However, it is contemplated that one more of the components of the nozzle 100 discussed above and herein may be alternatively manufactured from other processes including manual machining, computer numeric controlled (CNC) machining, or with other methods. Additionally, the nozzle 100 may be manufactured from a plurality of materials, including chromium, nickel, stainless steel, alloys, ceramics, etc. The materials may also be anti-corrosive and anti-stick to prevent a build-up of the reductant on and/or within the nozzle 100.

At the proximal end 104 of the nozzle 100, the nozzle 100 may include one or more inlets configured to receive reductant and/or air from the first air inlet channel 142. For example, the nozzle 100 may include a first inlet 108 for supplying the reductant solution 114 to the nozzle 100, and a second inlet 110 for supplying compressed air 116 to the nozzle 100.

In some examples, at the distal end 106 of the nozzle 100, the nozzle 100 can include one or more spray channel outlet(s) 112. According to embodiments described herein, a reductant/air solution 120 may enter the exhaust stream 102 through the one or more spray channel outlet(s) 112.

As discussed in detail herein, the nozzle 100 may facilitate mixing of reductant solution 114 and compressed air 116 to mix, aerate, separate, and/or atomize the reductant solution 114. According to an embodiment, an interior 118 of the nozzle 100 comprises a structure of the nozzle 100, where the structure comprises various passages and channels formed at least partly by the body of the nozzle 100. More particularly, within the nozzle interior 118 of the nozzle 100, air and reductant may mix together to form the reductant/air solution 120. This process may cause the reductant solution 114 to break up into fine particles or droplets at the interior first end 122 of the nozzle interior 118, and mix with the compressed air 116 at an interior second end 124 of the nozzle interior 118. As noted above, the nozzle 100 may disperse and/or otherwise direct the reductant/air solution 120 into the exhaust stream 102 through the one or more spray channel outlet(s) 112 disposed at the distal end 106 of the nozzle 100. Accordingly, as the reductant/air solution 120 disperses into the exhaust stream 102, the reductant/air solution 120 may react with NOx (e.g., NO and/or $NO_2$) to form water ($H_2O$) and elemental nitrogen ($N_2$).

According to an embodiment, the nozzle interior 118 may be bifurcated into two or more main chambers (e.g., the fluid impingement chamber 426 and the mixing chamber 128) by an impingement device 130. In some aspects, the impingement device 130 may fluidly connect the fluid impingement chamber 426 and the mixing chamber 128 via a plurality of orifices 138 that provide channels for the reductant/air solution 120 to pass from the fluid impingement chamber 426 to the mixing chamber 128. More particularly, an impingement device body 132 may be configured as a substantially flat disk or plate having an impingement pin 134 at a center of the impingement device body 132, where the impingement device body 132 seals against one or more mating surfaces such that reductant solution 114, compressed air 116, and/or reductant/air solution 120 may not pass through the impingement device 130 from the fluid impingement chamber 426 to the mixing chamber 128 except for through the plurality of orifices 138.

As explained in greater detail hereafter, the impingement pin 134 includes a convex surface 136 at a proximal end of the impingement device 130. In operation, the reductant solution 114 may be pumped or otherwise conveyed into the first inlet 108. Accordingly, when pumped into the nozzle 100, the reductant solution 114 travels through first inlet 108 and strikes the convex surface 136, where an approximate center of a laminar flow of the reductant solution 114 (the reductant solution 114 and the laminar flow of the reductant solution 114 depicted as an arrow in FIG. 1) strikes the convex surface 136 (approximately) at the apex of the convex surface 136.

The shape and position of the convex surface 136 is such that upon impinging the convex surface 136, the reductant solution 114 is dispersed into a mixture of ambient air and reductant solution. In some aspects, the orifices 138, which connect the fluid impingement chamber (where the fluid is broken up by the impingement pin 134) and the mixing chamber 128, are configured to further disperse the reductant and compressed air solution into smaller discrete droplets. For example, the orifices 138 can be configured to break the reductant/air mixture into droplets, atomize the reductant and air solution in part, or otherwise reduce the reductant and solution into an aerosol/droplet mixture. As explained in detail hereafter, the orifices 138 may also be configured to create turbulence in the mixing chamber 128 to further combine the compressed air 116 and the reductant solution 114, and form the reductant/air solution 120.

When the reductant solution is urea or contains urea, in some instances, the urea may react with heat such that crystallization of the reductant solution can occur above certain temperatures. Because the nozzle 100 may be operable as part of an exhaust system of a combustion engine, the nozzle 100 can reach temperatures ranging between approximately 200° C. to approximately 500° C. In some examples, the urea-water solution of reductant solution may crystalize at these high temperatures (e.g., between approximately 200° C. and approximately 500° C.), as water evaporates from the solution. When the urea crystalizes at high temperatures, deposits of the urea may form that can hinder the performance of the exhaust system. For example, the selective-catalytic reaction that removes particulates from the exhaust stream may be hindered by the urea crystal deposits, the nozzle outlet or other fluid ports may become clogged, etc.

To prevent crystallization of the reductant solution 114, according to an embodiment, the nozzle 100 may channel the compressed air 116 through a first air inlet channel 142. The compressed air 116, when mixed with the reductant solution 114, may cool the system and prevent crystallization of the urea in the reductant solution 114. Accordingly, the first air inlet channel 142 fluidly connects the second inlet 110 to the fluid impingement chamber 426. The second inlet channel 110 may direct the compressed air 116 into the fluid impingement chamber 426 at a predetermined angle with respect to the longitudinal axis 140. The predetermined angle of incidence of the compressed air 116 with respect to the impingement pin 134 may create a turbulent airflow within the fluid impingement chamber 126. For example, the predetermined angle between an axis of the first air inlet channel 142 and the longitudinal axis 140 may be about 90° (substantially perpendicular). As depicted in FIG. 1, the first air inlet channel 142 may be disposed opposite to a pin body surface of the impingement pin 134 such that a longitudinal center of the first air inlet channel 142 is substantially perpendicular to a curved outer surface of the impingement pin 134, and substantially perpendicular to the longitudinal axis 140. When the compressed air 116 hits the side of the impingement pin 134 at the predetermined angle, the compressed air 116 may be forced to mix with the reductant solution 116 in a way that combines and cools the impingement pin 134, the fluid impingement chamber 126, and the reductant solution 114.

In some aspects, the nozzle 100 may include two or more air inlet channels. For example, the nozzle 100 may include a second air inlet channel 144 disposed opposite to the pin body 135 of the impingement pin 134 such that a longitudinal center of the second air inlet channel may be substantially perpendicular to the outer surface of the pin body 135 of the impingement pin 134, and substantially perpendicular to the longitudinal axis 140. In yet another embodiment, more than two air inlet channels may be included at substantially perpendicular angles to the longitudinal axis 140, such that they are configured to be opposite to the pin body 135. As used herein, the phrase "opposite to the pin body 135" means that the pin body 135 may be configured to be directly in the laminar and/or turbulent flow of a fluid interacting with the pin body 135.

By injecting the compressed air 116 at a perpendicular angle to the longitudinal axis 140, the stream of compressed air 116 may interact with the curved exterior surface of the impingement pin 134 such that the compressed air 116 disperses at reflective angles within the fluid impingement chamber 426. For example, the angle of incidence of the linearly-flowing stream of compressed air 116 equals the angle of reflection of the stream of compressed air 116 as the air stream interacts with the impingement pin 134. Accordingly, when the radially curved pin body 135 interacts with the laminar flow of the stream of compressed air 116, the angle of reflection of the compressed air 116 is spread throughout the fluid impingement chamber 126. The turbulence caused by the compressed air 116 interacting with the curved pin body 135*f* mixes the compressed air 116 with the reductant solution 114 within the fluid impingement chamber 426. In combination with the dispersed reductant solution 114 (dispersed after hitting the convex surface 136), the reductant solution 114 may be cooled by the compressed air 116, which may be more turbulent and evenly mixed with the reductant solution 114. Because of the turbulence created by the combination/configuration of the first air inlet channel 142 and the reductant solution 114 interacting with the convex surface 136, the interior surfaces of the nozzle interior 118 may also be cooled to a temperature below the threshold for urea crystallization.

Figure 7:
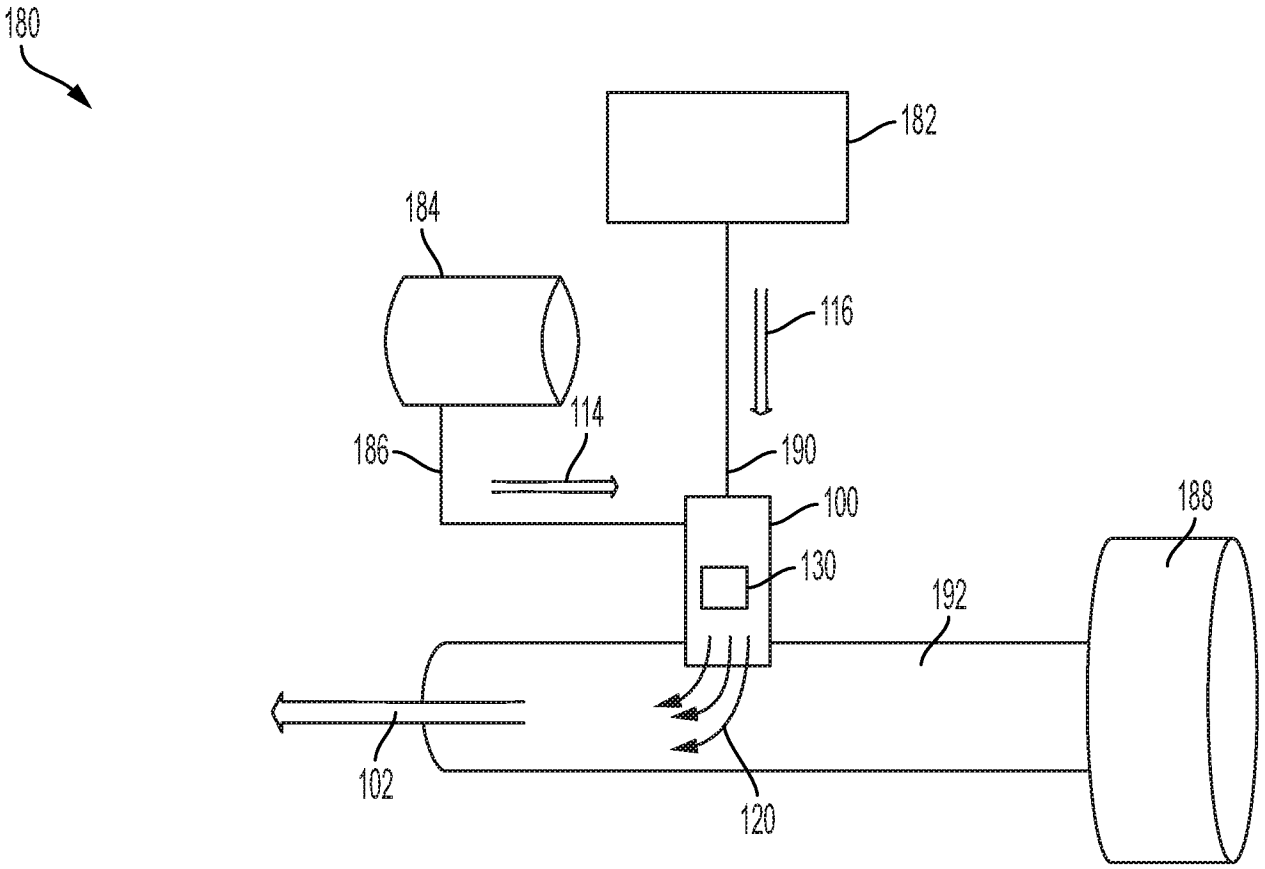
FIG. 7 is a schematic view of an exhaust system having a reductant nozzle, according to an embodiment of the present disclosure.

The nozzle 100 may be installed directly in the exhaust stream 102 of an exhaust system (e.g., as shown in FIG. 7, discussed in greater detail hereafter), in conventional SCR catalyst systems. Accordingly, in conventional emission systems a nozzle spraying diesel emission fluid (DEF) may build crystal deposits of urea, which can foul the exhaust system. In conventional systems, the nozzle can exceed the crystallization threshold of temperature for urea in the reductant solution 114. According to one or more embodiments, a combination of elements may provide optimal cooling and mixing properties: first, the compressed air 116 may be forced into the impingement pin 134 at an angle with respect to the impingement pin 134 that creates turbulence, and second, the reductant solution 114 may be interspersed with the turbulent air by the convex surface 136 within the fluid impingement chamber 426 such that the outer surface of the pin body of the impingement pin 134 may directly oppose the stream of compressed air 116. According to embodiments, this configuration the nozzle 100 configuration may cool both the reductant solution 114 and the nozzle interior 118.

Figure 2:
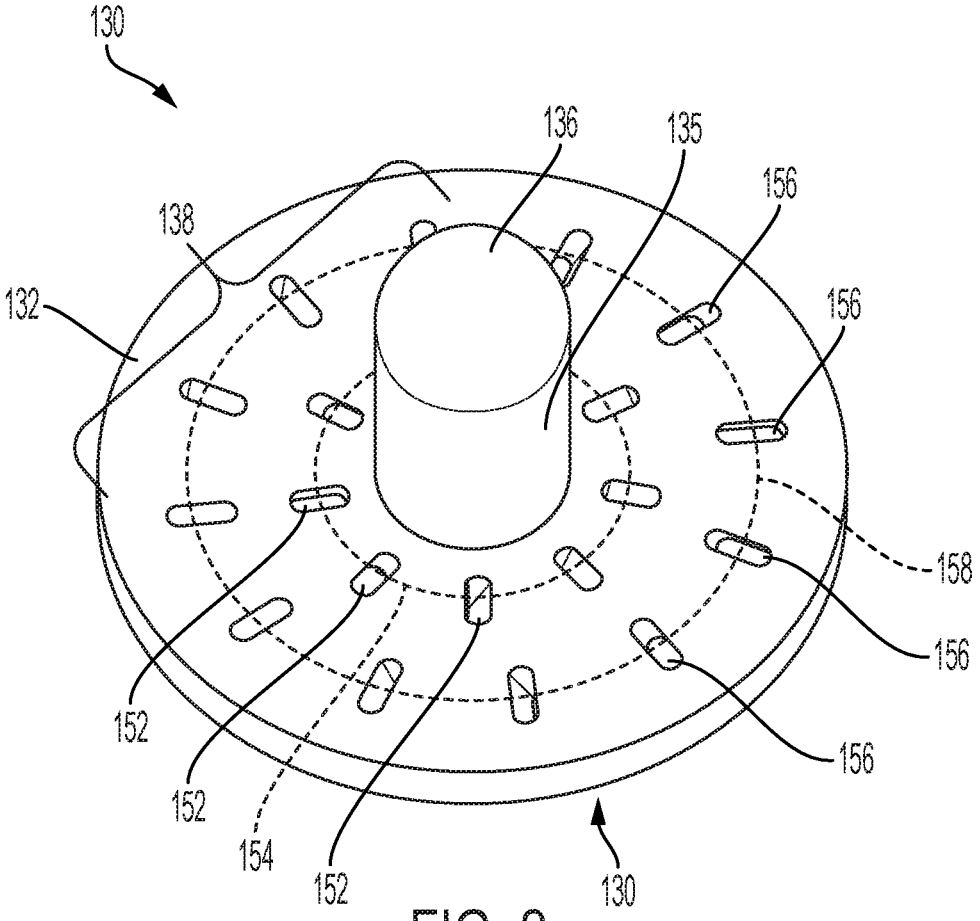
FIG. 2 depicts a perspective view of a reductant impingement device for use in the reductant nozzle of FIG. 1, according to an embodiment of the present disclosure.
Figure 3:
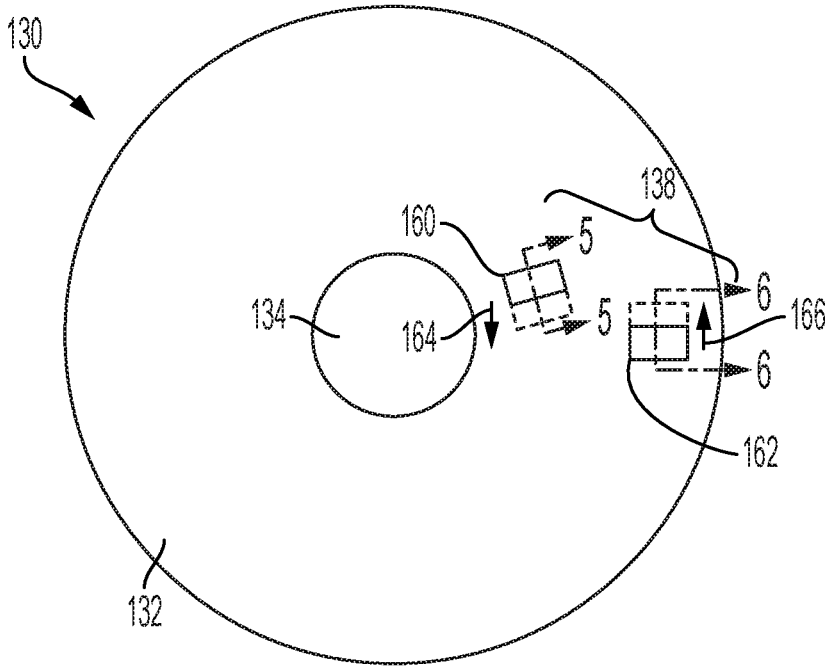
FIG. 3 depicts a top view of the reductant impingement device shown in FIG. 2, according to an embodiment of the present disclosure.
Figure 4:
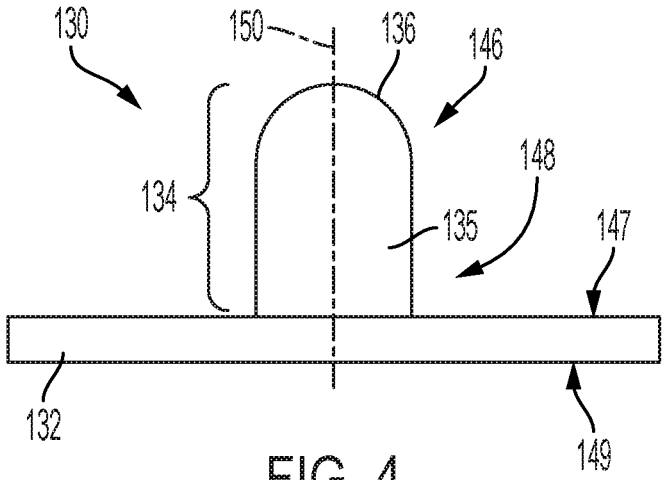
FIG. 4 is a front view of the reductant impingement device shown in FIG. 2, according to an embodiment of the present disclosure.

FIG. 2 depicts a perspective view of an example impingement device 130 for use in the reductant nozzle of FIG. 1, according to an embodiment of the present disclosure. FIG. 3 depicts a top view of the impingement device 130 shown in FIG. 2, according to an embodiment of the present disclosure. FIG. 4 is a front view of the impingement device 130 shown in FIG. 2, according to an embodiment of the present disclosure.

With reference to FIG. 3, according to one or more embodiments, the impingement device 130 may include an impingement device body 132, and the impingement pin 134 disposed to the impingement device body 132. The impingement device body 132 includes the orifices 138, which may be circumferentially disposed around the longitudinal axis 140 of the nozzle (FIG. 1), and more specifically, disposed around a second longitudinal axis (longitudinal axis 150, as shown in FIG. 4) of the impingement device 130. When the impingement pin 134 is configured as an assembly with the nozzle 100 (for example, as depicted in FIG. 1), the longitudinal axis 140 and second longitudinal axis 150 are colinear.

As shown in FIG. 2, the orifices 138 may be configured as through-channels circumferentially disposed around the second longitudinal axis 150. In one aspect, the plurality of orifices 138 are substantially equally circumferentially distributed around the longitudinal axis 140 of the nozzle 100 (and substantially equally circumferentially distributed around the second longitudinal axis 150).

In another aspect, the orifices 138 may be configured as two radial groupings such that one grouping of channels may be at a first radial distance 154 and the second grouping may be organized at a second radial distance 158. For example, a plurality of inner channels 152 may be disposed in circular array at the first radial distance 154 from the second longitudinal axis 150, and a plurality of outer channels 156 are disposed in a circular array at the second radial distance 158 from the second longitudinal axis 150 of the impingement pin 134. In one aspect, the first radial distance may be approximately ⅓ of the radial distance of the impingement device body 132 from the second longitudinal axis 150 to an outer edge of the impingement device body 132. In another aspect, the second radial distance may be approximately ⅔ of the radial distance of the impingement device body 132 from the second longitudinal axis 150 to an outer edge of the impingement device body 132. In other examples, the distance may be greater than or less than the radial distance of the impingement device body 132, such as, for example, ½ of the radial distance, 11/16 of the radial distance, etc.

With reference to the front view of the impingement pin 134 in FIG. 4, the pin body 135 of the impingement pin 134 is depicted with the convex surface 136 at a proximal end 146 of the pin body 135. The convex surface 136 of the impingement device 130 may be configured to oppose a flow direction of a fluid flow of the first inlet 108 of the nozzle 100 (FIG. 1). The convex surface 136 may be substantially hemispherical, according to an embodiment. The hemispherical shape is shown to disperse the reductant solution 114 (FIG. 1) in a way such that mixing of the reductant solution 114 with the compressed air 116 results in optimal cooling of the reductant/air solution 120.

Another benefit of the convex surface 136 may be ease of manufacture of the impingement device 130. In some embodiments, the impingement pin 134 may be machined from or otherwise manufactured as a unitary piece with respect to the impingement device body 132. In another embodiment, the impingement pin 134 may be a separate part from the impingement device body 132, and removably disposed to the impingement device body 132 using a mechanical fastener (not shown). In either case, the convex surface 136 may provide an optimal dispersing affect without introduction of multiple machining steps or extraneous parts to assemble.

With continued reference to FIG. 4, a first surface 147 may be configured to seal against an interior lip of the nozzle interior 118 such that the fluid impingement chamber 426 may be fluidly separate from the mixing chamber 128, except for the orifices 138 (which include plurality of inner channels 152, and the plurality of outer channels 156). With reference to FIG. 3, a partial top view of the orifices 138 is depicted (and more particularly, an inner channel 160, and an outer channel 162, of the orifices 138 is depicted). For the sake of simplicity of explanation, the top view in FIG. 3 shows only one inner channel 160 and one outer channel 162, although it should be appreciated that the plurality of channels (the orifices 138) may include any number of channels.

The inner channel 160 may be configured to direct fluid (e.g., the reductant solution 114, the compressed air 116, and/or the reductant/air solution 120) in a direction generally consistent with a channel direction 164. The outer channel 162 may be configured to direct fluid (e.g., the reductant solution 114, the compressed air 116, and/or the reductant/air solution 120) in a direction generally consistent with a directional arrow showing a channel direction 166. The inner channel 160 may be representative of the channel direction for all of the inner channels of the plurality of orifices 138 circumferentially disposed around the second longitudinal axis 150. The inner channel 160 fluidly connects the first surface 147 and the second surface 149.

According to another embodiment, the channel direction 164 and the channel direction 166 may be configured in another pattern such that the direction changes at every two channels, every three channels, etc. within the same radial distance. Other configurations are contemplated.

Figure 5:
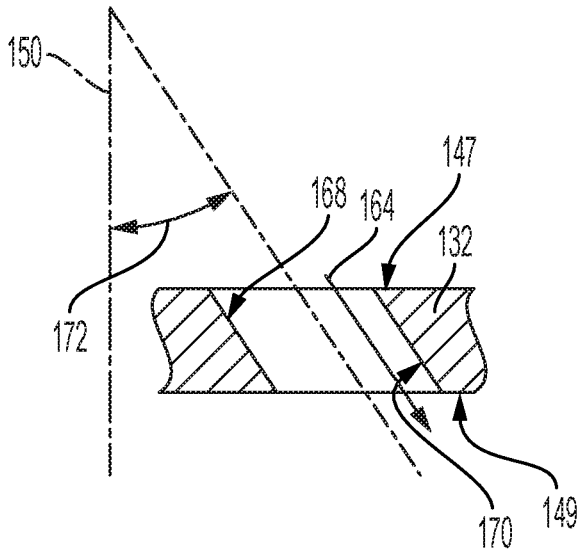
FIG. 5 depicts a section view of an inner channel of the reductant impingement device of FIGS. 2-4, according to an embodiment of the present disclosure.

FIG. 5 depicts a section view of an inner channel of the reductant impingement device of FIGS. 2-4, according to an embodiment of the present disclosure. The channel direction 164 indicates a general trajectory of any fluids passing through the inner channel 160. The inner channel 160 may be configured as a slit having two opposing inner channel walls. In one embodiment, the two inner channel walls can include a first inner channel wall 168 that may be disposed substantially parallel to a second inner channel wall 170. The two opposing channel walls form two sides of the inner channel 160. In one aspect, the first inner channel wall 168 and the second inner channel wall 170 are disposed at a first predetermined angle 172 with respect to the longitudinal axis of the impingement pin 134 (e.g., the second longitudinal axis 150). In one aspect, the first predetermined angle may be approximately 30° in another aspect, the first predetermined angle may be another angle such as, for example, 25°, or 35°, or greater or less than 25°, or 35°.

Figure 6:
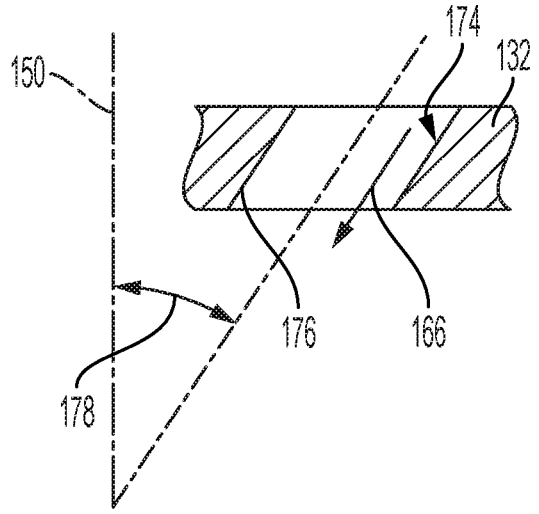
FIG. 6 depicts a section view of an outer channel of the reductant impingement device of FIGS. 2-4, according to an embodiment of the present disclosure.

FIG. 6 depicts a section view of an outer channel of the reductant impingement device of FIGS. 2-4, according to an embodiment of the present disclosure. The impingement device body 132 depicts a section view (Section B) of the outer channel 162, according to an embodiment. The channel direction 166 indicates a general trajectory of any fluids passing through the outer channel 162. The outer channel 162 may be configured as a slit having two opposing inner channel walls. In one embodiment, the two outer channel walls can include a first outer channel wall 174 that may be disposed substantially parallel to a second outer channel wall 176. The two opposing channel walls form two sides of the outer channel 162. In one aspect, the first outer channel wall 174 and the second outer channel wall 176 are disposed at a second predetermined angle 178 respective to the longitudinal axis of the impingement pin 134 (e.g., the second longitudinal axis 150). In one aspect, the second predetermined angle may be approximately 30°. In another aspect, the first predetermined angle may be another angle such as, for example, 25°, or 35°, or greater or less than 25°, or 35°. Notably, the channel direction 164 (FIG. 5), which depicts the fluid trajectory of fluids passing through the plurality of inner channels 152, may be opposite to the channel direction 166, which depicts the fluid trajectory of fluids passing through the plurality of outer channels 156.

FIG. 7 is a schematic view of an exhaust system 180 for an engine 188 that includes the nozzle 100, according to an embodiment of the present disclosure. The exhaust system 180 may further include an air compressor or other compressed air source 182 configured to supply compressed air 116 via a compressed air supply line 190, and one or more reservoirs and pumps configured as a reductant source 184. The reductant source 184 may be, for example, a DEF tank configured to supply the reductant solution 114 via a reductant solution supply line 186. The reductant solution supply line 186 may be fluidly connected with the first inlet 108 (FIG. 1).

In some embodiments, an amount of compressed air 116 and/or an amount of reductant solution 114 supplied to the system may be associated with a flow rate of the exhaust stream 102, an operational state of the engine 188 (e.g., rpm), a temperature of the exhaust stream 102, a concentration of a particular gas in the exhaust stream 102, and/or one or more other operating conditions of the exhaust system 180. For example, as the flow rate of the exhaust stream 102 decreases, a controller or other control component (not shown) operably connected to an air compressor and/or reductant pump may control the pump to commensurately decrease the amount of reductant solution 114 and/or compressed air 116 supplied to the nozzle 100 (and thereby introduced into the exhaust stream 102). Alternatively, as the flow rate of the exhaust stream 102 increases, a controller or other control component (not shown) may increase and/or decrease the amount of reductant solution 114 and/or compressed air 116 supplied to the nozzle 100. Consequently, the amount of reductant/air solution 120 introduced into the exhaust stream 102 may be controllable by a controller.

In some embodiments, the nozzle 100 may be located downstream from a SCR system, or be operable as part of a SCR system within an exhaust pipe 192 and/or other treatment systems. The exhaust system 180 may also include one or more oxidation catalysts, mixing features, particulate filters (e.g., diesel particulate filter (DPF)), SCR substrates, ammonia reduction catalysts, and other devices configured to further enhance the effectiveness of reducing NOx (devices not shown). Additionally, while only one nozzle 100 is shown, in some embodiments, the exhaust system 180 may include more than one nozzle 100. Moreover, the exhaust system 180 may include any number of exhaust pipes 192 having one or more nozzles 100 positioned therein.

INDUSTRIAL APPLICABILITY

The nozzle 100, impingement device 130, and exhaust system 180 may increase exhaust system efficiency and operability by decreasing and/or eliminating crystallization of urea compounds or other reactants due to adverse response to exhaust system heat. The embodiments described herein may increase turbulence and mixing within the nozzle 100 such that reductant solution 114 may be maintained at operable temperatures while treating the exhaust stream 102 in an exhaust system of a combustion engine.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof

What is claimed is:

1. A nozzle, comprising:

a nozzle body comprising:

a proximal end defining a first inlet and a second inlet that is distinct from the first inlet, an axis of the first inlet being disposed parallel to a longitudinal axis of the nozzle, an axis of the second inlet being disposed at an angle perpendicular to the longitudinal axis of the nozzle;

a distal end disposed opposite the proximal end along the longitudinal axis of the nozzle, the distal end comprising an outlet defining a plurality of outlet orifices therethrough; and an interior disposed between the proximal end and the distal end, the interior including:

a fluid impingement chamber fluidly connected with the first inlet and the second inlet, and a mixing chamber; and an impingement device disposed within the interior of the nozzle body, the impingement device including an impingement pin and an impingement device body extending radially outward from the impingement pin along a radial direction, the radial direction being transverse to the longitudinal axis of the nozzle, the impingement device body defining a plurality of impingement body orifices therethrough, the mixing chamber being fluidly coupled to the fluid impingement chamber via the plurality of impingement body orifices, the impingement pin extending away from the impingement device body along the longitudinal axis of the nozzle, the impingement pin including a convex surface disposed at an end of the impingement pin, wherein the convex surface is concentric with the longitudinal axis of the nozzle, the plurality of outlet orifices being fluidly coupled with the plurality of impingement body orifices via the mixing chamber.

2. The nozzle of claim 1, wherein the first inlet is a reductant fluid inlet and the second inlet is a compressed air inlet.

3. The nozzle of claim 1, wherein the convex surface is hemispherical, and wherein the convex surface is arranged to impinge directly against a flow of a fluid passing through the first inlet.

4. The nozzle of claim 1, wherein the impingement device body has a first surface and a second surface facing away from the first surface, wherein one or more of the first surface and the second surface forms a fluid seal through contact with the interior of the nozzle body, and wherein each orifice of the plurality of impingement body orifices extends from the first surface to the second surface.

5. The nozzle of claim 1, wherein the axis of the second inlet is perpendicular to an outer surface of the impingement pin and perpendicular to the longitudinal axis of the nozzle.

6. The nozzle of claim 5, wherein the proximal end of the nozzle body defines a first air inlet channel and a second air inlet channel, the second inlet being the first air inlet channel, and wherein an axis of the second air inlet channel is perpendicular to the outer surface of the impingement pin and perpendicular to the longitudinal axis of the nozzle.

7. The nozzle of claim 1, wherein each orifice of the plurality of impingement body orifices is disposed circumferentially about the longitudinal axis of the nozzle.

8. The nozzle of claim 7, wherein each orifice of the plurality of impingement body orifices is spaced equally from an adjacent orifice of the plurality of impingement body orifices about a circumferential direction, the circumferential direction extending about the longitudinal axis of the nozzle.

9. The nozzle of claim 8, wherein the plurality of impingement body orifices includes a first plurality of impingement orifices and a second plurality of impingement orifices, an axis of each orifice of the first plurality of impingement orifices forming a first angle with respect to a first surface of the impingement device, an axis of each orifice of the second plurality of impingement orifices forming a second angle with respect to the first surface of the impingement device, the first angle being different from the second angle.

10. An impingement device, comprising:

an impingement pin and a device body, the device body being coaxial with a longitudinal axis of the impingement pin, and being disposed at a distal end of the impingement device, wherein the impingement pin comprises a convex surface disposed at a proximal end of the impingement device, and wherein the device body comprises:

a first surface;

a second surface opposite the first surface;

a plurality of inner channels connecting the first surface and the second surface, the plurality of inner channels being disposed in a first circular array at a first radial distance from the longitudinal axis of the impingement pin; and a plurality of outer channels connecting the first surface and the second surface, the plurality of outer channels being disposed in a second circular array at a second radial distance from the longitudinal axis of the impingement device, the first radial distance being less than the second radial distance.

11. The impingement device of claim 10, further comprising a plurality of slits forming the plurality of inner channels connecting the first surface and the second surface.

12. The impingement device of claim 11, wherein a first inner channel of the plurality of inner channels comprises two opposing inner channel walls, wherein the two opposing inner channel walls comprise a first inner channel wall disposed parallel to a second inner channel wall, and wherein the first inner channel wall and the second inner channel wall are disposed at a first predetermined angle respective to the longitudinal axis of the impingement pin.

13. The impingement device of claim 11, wherein a first outer channel of the plurality of outer channels comprises two opposing outer channel walls, wherein the two opposing outer channel walls comprise a first outer channel wall disposed parallel to a second outer channel wall, and wherein the first outer channel wall and the second outer channel wall are disposed at a second predetermined angle respective to the longitudinal axis of the impingement pin.

14. The impingement device of claim 11, wherein the convex surface is hemispherical and disposed at a terminal end of the impingement pin, wherein the convex surface is configured to impinge a fluid flow of a fluid.

15. An exhaust system, comprising:

an exhaust pipe configured to receive exhaust from an engine;

a compressed air source;

a reductant source; and a nozzle fluidly connected with the exhaust pipe, the nozzle being configured to receive compressed air from the compressed air source and reductant from the reductant source, the nozzle having a nozzle body and an impingement device disposed within the nozzle body, the nozzle body comprising:

a proximal end defining a first inlet and a second inlet that is distinct from the first inlet, an axis of the first inlet being disposed parallel to a longitudinal axis of the nozzle, an axis of the second inlet being disposed at an angle perpendicular to the longitudinal axis of the nozzle;

a distal end disposed opposite the proximal end along the longitudinal axis of the nozzle, the distal end comprising an outlet defining a plurality of outlet orifices therethrough; and an interior disposed between the proximal end and the distal end, the interior including:

a fluid impingement chamber fluidly connected with the first inlet and the second inlet, and a mixing chamber, the impingement device comprising an impingement pin and an impingement device body extending radially outward from the impingement pin along a radial direction, the radial direction being transverse to the longitudinal axis of the nozzle, the impingement device body defining a plurality of impingement body orifices therethrough, the mixing chamber being fluidly coupled to the fluid impingement chamber via the plurality of impingement body orifices, the impingement pin extending away from the impingement device body along the longitudinal axis of the nozzle, the impingement pin including a convex surface disposed at an end of the impingement pin, wherein the convex surface is concentric with the longitudinal axis of the nozzle the plurality of outlet orifices being fluidly coupled with the plurality of impingement body orifices via the mixing chamber.

16. The exhaust system of claim 15, wherein the first inlet is a reductant fluid inlet and the second inlet is a compressed air inlet.

17. The exhaust system of claim 15, wherein the convex surface is hemispherical, and wherein the convex surface is arranged to impinge directly against a flow of a fluid passing through the first inlet.

18. The exhaust system of claim 15, wherein the impingement device body has a first surface and a second surface facing away from the first surface, wherein one or more of the first surface and the second surface forms a fluid seal through contact with the interior of the nozzle body, and wherein each orifice of the plurality of impingement body orifices extends from the first surface to the second surface.

19. The exhaust system of claim 15, wherein the axis of the second inlet is perpendicular to an outer surface of the impingement pin and perpendicular to the longitudinal axis of the nozzle.

20. The exhaust system of claim 19, wherein the proximal end of the nozzle body defines a first air inlet channel and a second air inlet channel, the second inlet being the first air inlet channel, and wherein an axis of the second air inlet channel is perpendicular to the outer surface of the impingement pin and perpendicular to the longitudinal axis of the nozzle.

* * * * *